US010233015B2

(12) United States Patent
Arnesen

(10) Patent No.: US 10,233,015 B2
(45) Date of Patent: Mar. 19, 2019

(54) CONTAINER, CONTAINER KIT AND METHOD FOR ASSEMBLY OF CONTAINER KIT

(71) Applicant: Nordisk Aviation Products AS, Holmestrand (NO)

(72) Inventor: Christian Arnesen, Holmestrand (NO)

(73) Assignee: Nordisk Aviation Products AS, Holmestrand (NO)

( * ) Notice: Subject to any disclaimer, the term of this patent is extended or adjusted under 35 U.S.C. 154(b) by 255 days.

(21) Appl. No.: 15/179,130

(22) Filed: Jun. 10, 2016

(65) Prior Publication Data

US 2016/0362248 A1 Dec. 15, 2016

(30) Foreign Application Priority Data

Jun. 10, 2015 (NO) ..... 20150749

(51) Int. Cl.
*B65D 19/02* (2006.01)
*B65D 90/08* (2006.01)
*B65D 88/14* (2006.01)

(52) U.S. Cl.
CPC ..... *B65D 90/08* (2013.01); *B65D 88/14* (2013.01)

(58) Field of Classification Search
CPC ..... B65D 90/08; B65D 88/14; B65D 88/121; B65D 88/526; B65D 2519/00024; B65D 2519/00587; B65D 19/08; B65D 19/02; B65D 19/06; B65D 19/12; B65D 19/16; B65D 7/24

(Continued)

(56) References Cited

U.S. PATENT DOCUMENTS 3,655,087 A * 4/1972 Luisada ..... B65D 9/12 220/1.5
4,923,076 A 5/1990 Weiss et al.

FOREIGN PATENT DOCUMENTS

JP 5972222 A 5/1984
JP 07232729 9/1995

(Continued)

OTHER PUBLICATIONS

Norwegian Office action in patent application No. 20150749, filed Jan. 7, 2016.

(Continued)

*Primary Examiner* — Fenn C Mathew
*Assistant Examiner* — Elizabeth J Volz
(74) *Attorney, Agent, or Firm* — Oppedahl Patent Law Firm LLC

(57) ABSTRACT

The invention relates to a freight container (1), such as an air freight container, or an freight container kit comprising a base (3), a framework and panels (2) forming side walls and roof, where an elongated area along the edge of at least two of the panels (2) of the container are folded to form open profiles (5) fitting into a corresponding open profile in an adjoining panel in such a way that the open profiles form a closed hollow profile (9) when combined.
The invention also relates to a method for assembling the above freight container kit, comprising the steps of; providing a base (3), arranging frame elements (4) at least around the access opening, joining and fixing the open profiles (5) of neighboring panels to each other and joining and fixing the frame elements (4) to the edges of the panels (2) lacking open profiles (5) and to the base (3).

15 Claims, 7 Drawing Sheets

(58) Field of Classification Search
USPC ..... 220/1.6, 4.28, 660, 668, 669, 670, 1.5, 220/682; 206/386, 600
See application file for complete search history.

(56) References Cited

FOREIGN PATENT DOCUMENTS

| | | | | | |
|---|---|---|---|---|---|
| JP | 08119376 | * | 5/1996 | ..... | B65D 88/12 |
| JP | 08119376 | A | 5/1996 | | |
| JP | 1081391 | A | 3/1998 | | |
| JP | 2979506 | B1 | 9/1999 | | |

OTHER PUBLICATIONS

Norwegian Industrial Property Office Search Report, dated Jan. 7, 2016.

* cited by examiner

CONTAINER, CONTAINER KIT AND METHOD FOR ASSEMBLY OF CONTAINER KIT

The present invention relates to improvements in light weight containers, especially containers suited for air cargo, also called Unit Load Devices (ULD). More specifically, does the invention relate to improved sidewalls for light weight containers and containers comprising such side walls.

There are many ways to manufacture containers. However, when the containers are made for use in air freight, there are several requirements that should be fulfilled. The container should be light weight to save fuel during transport, and to improve handling ability of the container. The container should also withstand impacts from the cargo inside, e.g. during turbulence and from the outside during handling, loading and unloading of containers in an airport or any other freight related site.

As the containers can be sold as a kit that must be assembled when received, it is also an advantage if the containers are easy to assemble from a limited number of elements.

Air freight containers are normally made from a sturdy pallet on which walls and top are mounted, normally in a framework. The pallet and framework are often made from aluminium, as aluminium has a good relationship between weight and strength. Furthermore, aluminium is an easily formed material, which gives the flexibility in the design of pallet, framework and walls. The sidewalls of the container are normally made of metal, such as aluminium, or of a fabric.

When the walls are made of metal, the wall panels must be fixed to the framework in a sufficiently strong way. However, as the containers are handled and transported in moving surroundings, there is a continuous attention towards fatigue fractures in the transition between pallet, walls and framework.

It is an object with the present invention to present an improved light weight container with metal sidewalls, where the container is easy to assemble and where the container presents improved strength and fatigue characteristics compared to prior art containers.

Therefore the present description presents a container, such as an air freight container, comprising a base, a framework and panels forming side walls and roof, where an elongated area along the edge of at least two of the panels of the container are folded to form open profiles fitting into a corresponding open profile in an adjoining panel in such a way that the open profiles form a closed hollow profile when combined.

The provision of an open profile along at least one edge of at least one pair of the side wall and/or roof panels provides an improved connecting element for the panels. The open profiles along the edge of at least two panels enables a quick and easy connection of the panels being provided with the open profiles. Furthermore, the open profiles are combined to form closed hollow profiles running along the interface between two adjoining panels. These closed hollow profiles will be a part of the framework of the container that, contrary to traditional frame work elements on prior art containers, are a continuation of the panels of the container. These will improve the contact area between the two profiled edges.

The improved panels with profiled edges, thereby comprising at least one hollow profile can be made in formable metal sheet. It is envisaged that the panels comprising at least one hollow profile are made from rolled aluminium sheet.

Making the panels from metal sheet will provide sufficient strength to the panels, while maintaining a sufficiently low weight. Metal is also a suitable material, as it is possible to roll and bend the sheet to a new continuous shape without compromising with the mechanical properties of the material.

In a preferred embodiment, the open profile comprises two side walls and a bottom, as this cross section makes it possible to form a four-sided closed profile with the overlapping side walls and the bottoms of two profiles as the four sides of the profile when two panels are joined together.

In other words, the side walls of the open profile of a first panel are arranged along the side walls of a second panel, the side walls being fixed to each other, so that the overlapping side walls and opposing bottoms of two open profiles form a closed hollow profile.

As the profiles are made as an integrated part of the panels, there will be a continuous transition between the panels and the closed hollow profiles. Thereby, the connection between the panels and the closed profiles, that will be a part of the container framework, will be very tight.

As the closed hollow profiles formed at the interface between two panels passes across the width of the panel from one side to the other, the closed hollow profiles will form a part of the framework of the container. By integrating the framework in the panels, the need for separate framework elements is minimized, thereby reducing cost and material use.

The sidewalls of the profiles can be provided with holes, suitable for receiving fastening means. When the side walls of two adjoining panels are overlapping, the overlapping holes in the side walls will provide a predefined locations of fastening means. It is possible to use e.g. pop-rivets, screws or bolts to quickly connect the panels to each other.

The invention also relates to a freight container kit comprising a base, framework elements and side wall and roof panels, where an elongated area along the edge of at least two of the panels are folded to form open profiles being combinable with the open profile of another panel to form a closed hollow profile.

In a preferred embodiment, the open profile or profiles comprise two side walls and a bottom, the side walls standing on each side of the bottom forming an angled U-shape.

The invention also relates to a method for assembling the above referenced container or freight container kit, comprising the steps of:

- providing a base,
- providing frame elements at least around an access opening,
- providing panels forming side walls and roof of the container, where at least two panels comprises an open hollow profile along at least one edge of the panels,
- joining and fixing the open profiles of neighboring panels to each other,
- joining and fixing the frame elements to the edges of the panels lacking open profiles and to the base.

In a preferred embodiment, the open profiles of neighboring panels are fixed to each other by means of fastening means in a predefined number of holes in the side walls.

The invention will now be further described by means of a non-limiting illustrative embodiment of a container with improved side panels.

Figure 4A:
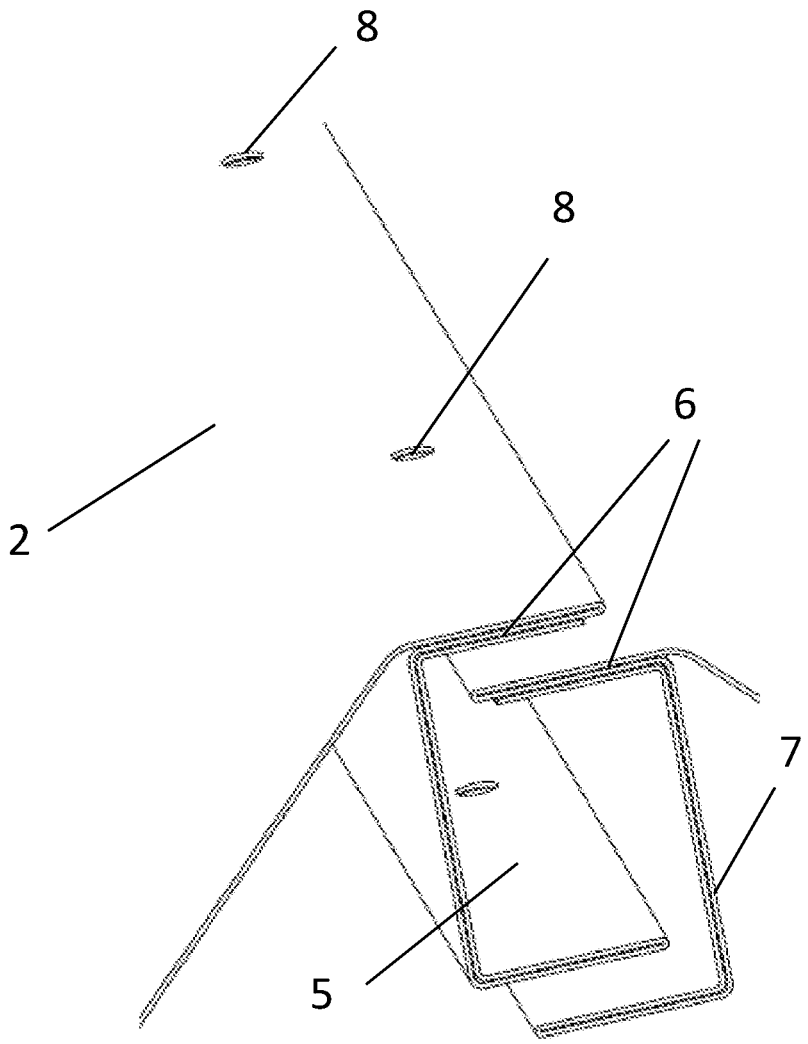

FIG. 4*a* shows a perspective sectional view of a part of two panels according to the present invention.

Figure 4B:
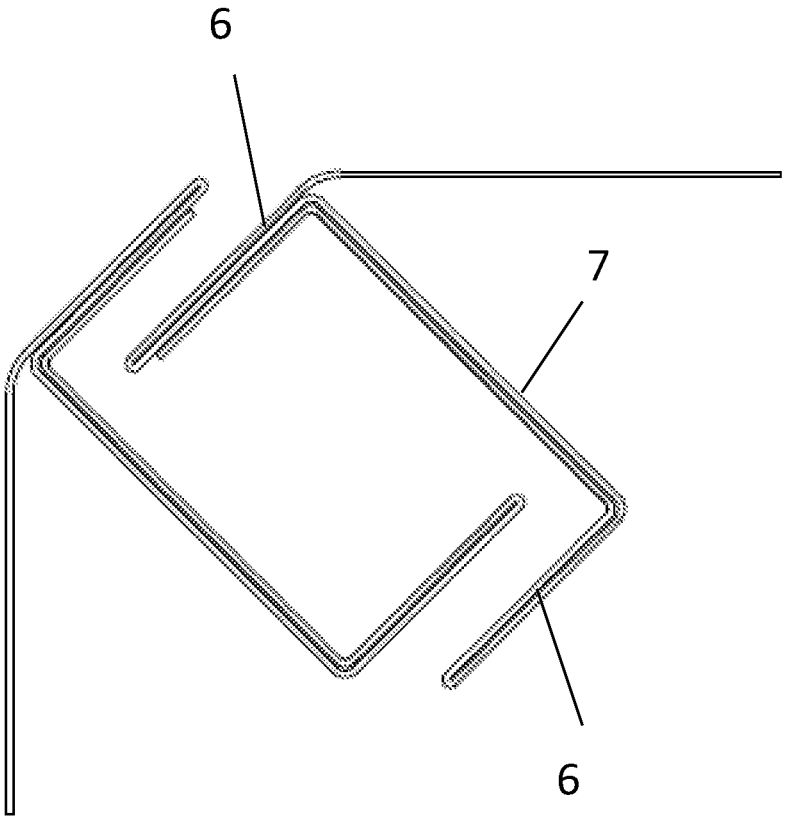
Figure 5A:
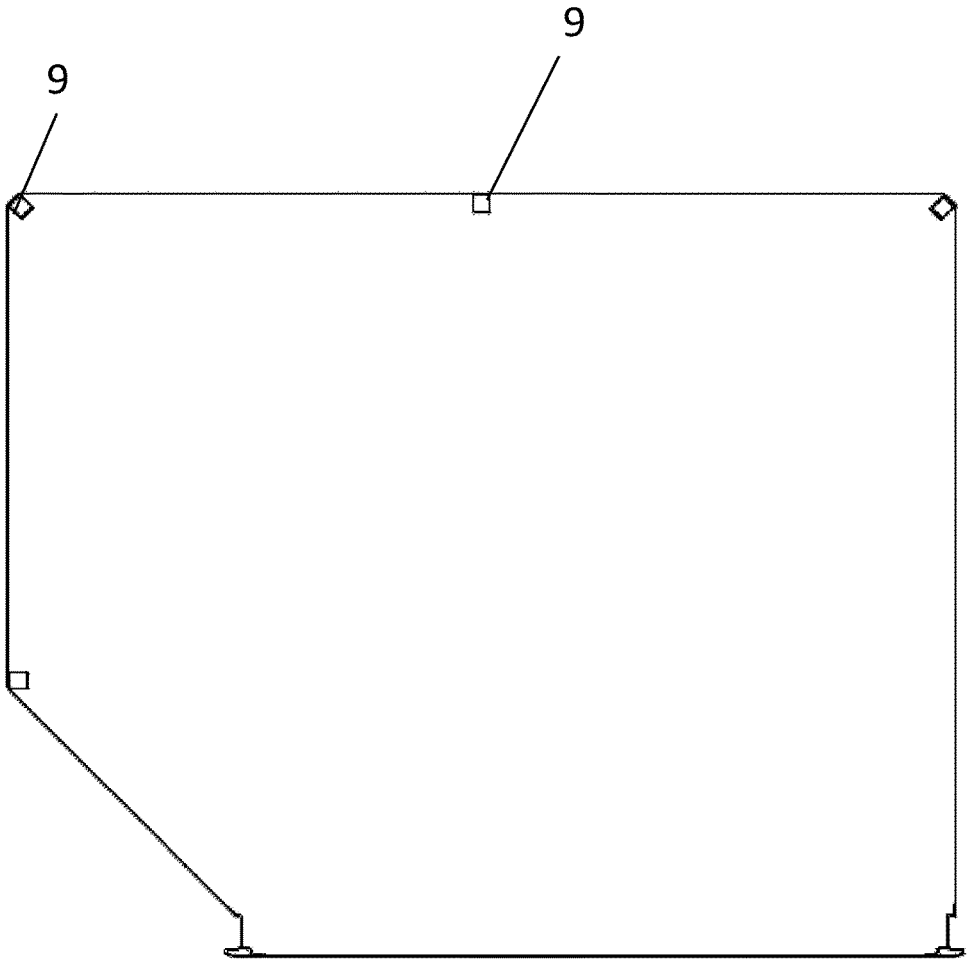

FIG. 4*b* shows a cross sectional view of the two panels in FIG. 5*a*.

FIG. 5*a* shows a cross section of a container with the improved panels.

Figure 5B:
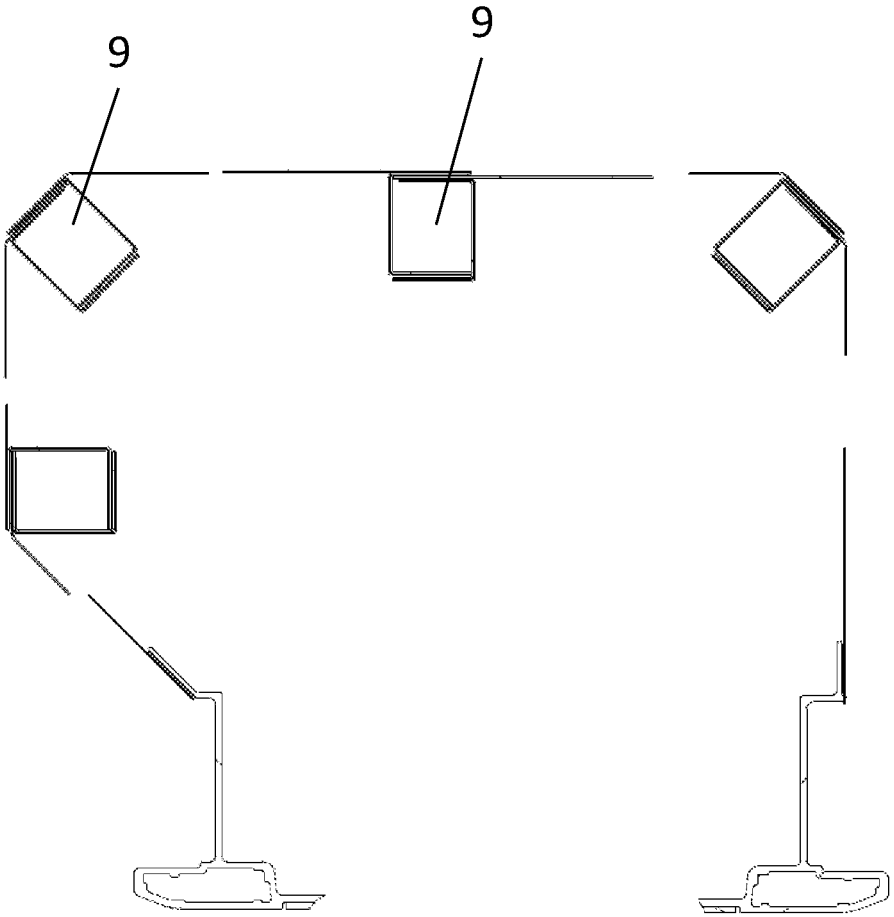

FIG. 5*b* shows the joints of the cross section in FIG. 4*a*.

Figure 1:
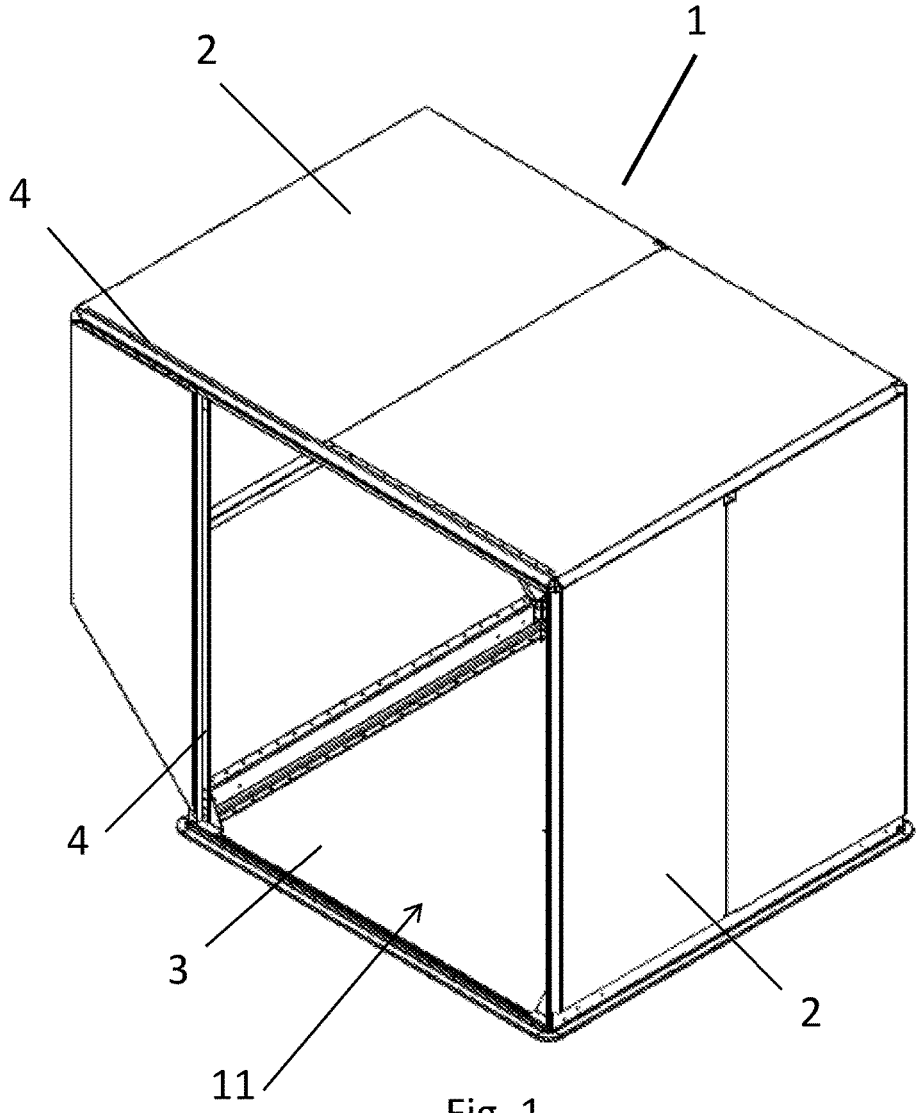
FIG. 1 shows an example of a container comprising the improved panels.

FIG. 1 shows an example of a container 1 comprising embodiments of the improved panels 2. The container 1 is an air freight container, also called a ULD container. The container comprises a pallet 3, panels 2 forming the side walls and roof and frame elements 4.

Figure 2:
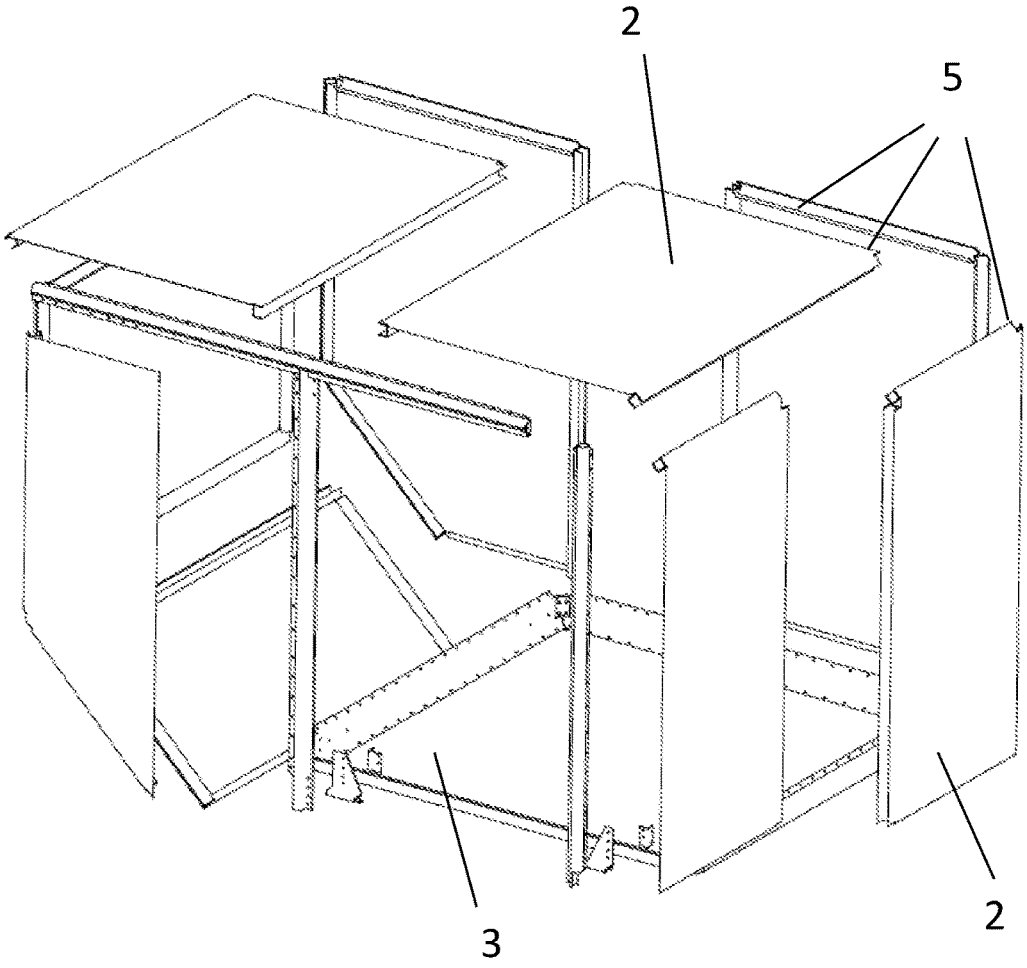
FIG. 2 shows an exploded view of the container in FIG. 1.

FIG. 2 shows an exploded view of the container. The pallet 3 form the base of the container. Frame elements 4 are arranged around the access opening 11 of the container. The panels 2 are formed as plane sheet where at least one edge of the sheet is folded to form an open profile 5 along the length of the edge. This will be further explained below. The profiles 5 of two adjoining panels 2 are fitting into each other to form a closed hollow profile along the connection area of neighbouring panels.

The panels are preferably made in formable metal sheet, such as aluminium sheet. However, it is also envisaged to use other metals than aluminium, as most metals, or at least alloyed metals, are formable, and will provide the required mechanical properties.

Figure 3:
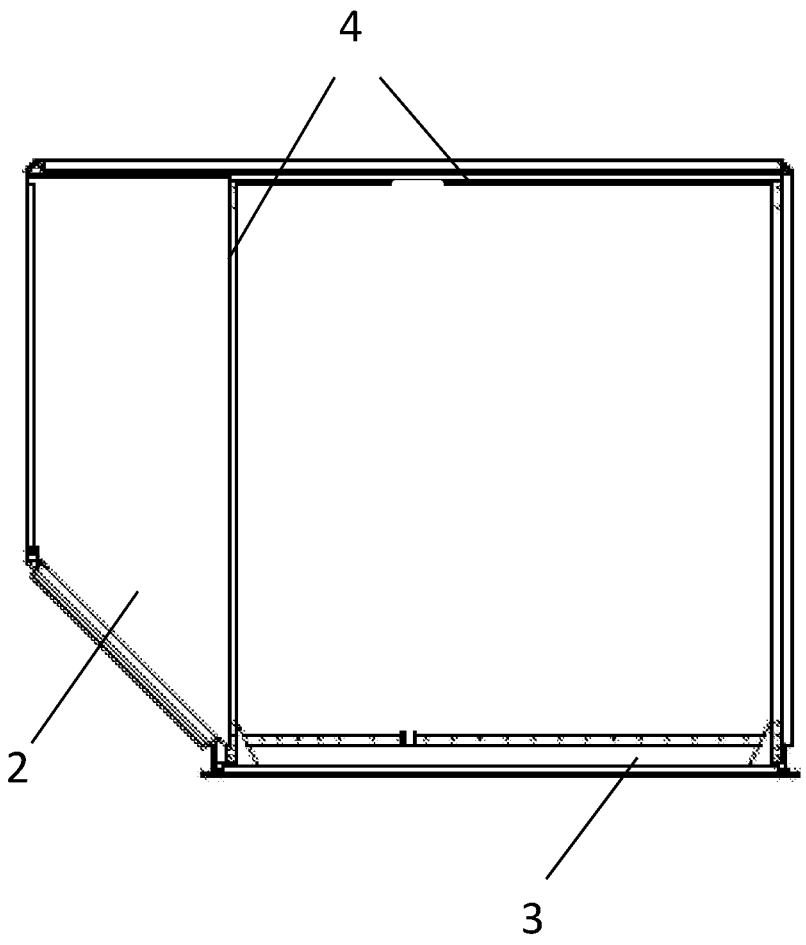
FIG. 3 shows a side view of the container in FIG. 1.

FIG. 3 shows a side view of the container in FIG. 1 where the frame elements 4 are standing on the pallet 3. The frame elements 4 are connected to the panels 2 bordering the access opening with known joining techniques. The edges of the panels that are not connected to frame elements are provided with open profiles that are connected to the profiles of the neighbouring panels.

FIG. 4*a* shows a perspective sectional view of a part of two panels with profiles 5 in the process of being combined with each other. To form the profile 5, an elongated area along outer edge of the panel is folded and compressed to form a profile comprising sidewalls 6 and a bottom 7. There is a mainly right angle between the side walls 6 and the surface of the bottom 7. Thereby the side walls are mainly parallel to each other. To reinforce the profile, the elongated area of the sheet is folded multiple times in such a way that the side walls and bottom are formed with more than one sheet layer. This is beneficial to ensure a sufficiently strong framework for the container with panels according to the invention. In the shown embodiment the side walls are provided with holes 8 suitable for entering fastening means.

FIG. 4*b* shows a cross sectional view of the two panels in FIG. 4*a*, more clearly showing how the edge area of the sheet is folded multiple times to form the profile 5. The side walls of two panels to be connected are fitting into each other thereby forming a closed hollow profile. The side walls are fixed to each other by fastening means. When all panels being provided with profiles are fixed to the adjoining panel, the closed hollow profiles will form part of the framework of the container. As the profiles are an integrated part of the panels, there will be a more continuous surface on the container, compared to containers where side wall and roof panels are fixed to a complete framework.

As the profiles 5 of the panels form a part of the frame work, there will be a diminished need for frame work elements, which will simplify the assembling procedure for the container. This may lead to a faster assembly of the containers, as the combination of the open profiles of two adjoining profile is intuitive and simple. Furthermore, is it likely that the possibility to connect at least a part of the panels of a container directly to each other without the need for additional frame elements, will improve the fatigue properties of the container.

FIG. 5*a* shows a cross section of a container with the improved panels showing the closed hollow profiles 9. In FIG. 5*b* the panels are cut, so that the cross section of the hollow profiles can be seen. The open profile 5 along the edges of the panels can be angled in relation to the surface of the panel, or one of the side walls can be a continuation of the surface of the panel. Thereby it is possible to provide any angle needed between two panels. If two panels with an angled open profile are combined, a corner will be formed on the container. If a continuous surface, e.g. over the roof or a larger side wall is needed, a first side walls of the open profiles are maintained as a continuation of the surface of the panels. By bending the first side wall of the open profiles into different angles, any angular transition between two panels can be obtained.

It should be noted that the side walls and bottom of the open profile can be modified in such a way that the side walls and bottom form a half circle over the bottom instead of straight surfaces. If two half circle shaped open profiles are combined, the closed profiles will form tube shaped frame elements. It is also possible to combine curved and right angled open profiles, to customize and optimize the frame elements to each specific container and to the requirements related to the container.

It is also possible to modify the angles between the side walls and bottom therebetween to form any other desired cross section of the final closed hollow profiles. It is also envisaged to provide open profiles with different cross sections in a container to customize the frame elements of each part of the container.

Even if the improved panels are showed in relation to one specific container design, it is obvious that the panels can be used in any light weight container where panels and framework elements are combined onto a base to form the container.

Even if the panels in the drawings are straight, it is also envisaged to provide the folded edges on curved panels where one edge of two adjoining panels is straight. Thus, the invention is not limited to the examples shown or suggested in the above but may be modified and varied by the skilled person within the terms and their equivalents of the appended claims.

The invention claimed is:

1. A freight container (1), comprising a base (3), a framework and panels (2) forming side walls and roof, wherein an elongated area along the edge of at least two of the panels (2) of the container are folded to form open profiles (5) fitting into a corresponding open profile in an adjoining panel in such a way that the open profiles form a closed hollow profile (9) when combined, wherein the panels (2) comprise at least one hollow profile (5) made of formable metal sheet, and wherein at least one of the open profiles (5) has a cross-section substantially in the form of a U and has a bottom (7) and two side walls (6), the bottom and side walls being formed with more than one layer of said formable metal sheet.

2. The freight container according to claim 1, wherein the panels (2) comprise at least one hollow profile (5) are made from rolled aluminum sheet.

3. The freight container according to claim 1, wherein at least a part of the open profile (5) forms a half circle shaped bottom.

4. The freight container according to claim 3, wherein the side walls are provided with a number of holes with a predefined distribution suitable for fastening means.

5. The freight container according to claim 1, wherein the closed hollow profile (9) forms part of the framework of the container (1).

6. The freight container according to claim 1, wherein one of the side walls (6) is bent back along the panel (2) so as to form an additional layer of formable metal sheet in said one side wall.

7. The freight container according to claim 6, wherein the bottom and the other of the side walls have two layers of formable metal sheet.

8. The freight container according to claim 7, wherein the said one side walls (6) of the open profiles (5) being bent back along the respective panel (2), are made to overlap when forming said closed hollow profile (9), said other side walls also overlap when forming said closed hollow profile (9).

9. The freight container according to claim 8, wherein the overlapping side walls are connected to each other by one or more of rivets, screws, bolts, and adhesive.

10. The freight container according to claim 6, wherein the said one side walls (6) of the open profiles (5) being bent back along the respective panel (2), are made to overlap when forming said closed hollow profile (9).

11. The freight container according to claim 10, wherein the overlapping side walls are connected to each other by one or more of rivets, screws, bolts, and adhesive.

12. The freight container according to claim 1, wherein the freight container is an air freight container.

13. A freight container kit comprising a base (3), framework elements (4) and side wall and roof panels (2), wherein an elongated area along the edge of at least two of the panels (2) is folded to form an open profile (5) being combinable with an open profile (5) of another panel (2) to form a closed hollow profile (9), wherein at least one of the open profiles (5) is made of formable metal sheet and has a cross-section substantially in the form of a U and has a bottom (7) and two side walls (6), the bottom and side walls being formed with more than one layer of said formable metal sheet.

14. A method for assembling the freight container kit according to claim 13, comprising the steps of:

providing a base (3), arranging frame elements (4) at least around an access opening, joining and fixing the open profiles (5) of neighboring panels to each other, joining and fixing the frame elements (4) to the edges of the panels (2) lacking open profiles (5) and to the base (3).

15. The method according to claim 14, further comprising the step of:

fixing the open profiles (5) of neighboring panels to each other by means of fastening means in a predefined number of holes in the side walls.

* * * * *